US008021497B2

(12) United States Patent
Fleischanderl et al.

(10) Patent No.: US 8,021,497 B2
(45) Date of Patent: Sep. 20, 2011

(54) METHOD FOR PRODUCING A HARDENED STEEL PART

(75) Inventors: Martin Fleischanderl, Rainbach i.M. (AT); Siegfried Kolnberger, Pasching (AT); Josef Faderl, Steyr (AT); Gerald Landl, Linz (AT); Anna Elisabeth Raab, Linz (AT); Werner Brandstätter, Linz (AT)

(73) Assignee: voestalpine Stahl GmbH, Linz (AT)

( * ) Notice: Subject to any disclaimer, the term of this patent is extended or adjusted under 35 U.S.C. 154(b) by 708 days.

(21) Appl. No.: 10/566,059

(22) PCT Filed: Jun. 9, 2004

(86) PCT No.: PCT/EP2004/006251

§ 371 (c)(1),
(2), (4) Date: Apr. 11, 2007

(87) PCT Pub. No.: WO2005/021822

PCT Pub. Date: Mar. 10, 2005

(65) Prior Publication Data

US 2007/0256808 A1 Nov. 8, 2007

(30) Foreign Application Priority Data

Jul. 29, 2003 (AT) ..... A 1202/2003
Jul. 29, 2003 (AT) ..... A 1203/2003

(51) Int. Cl.

| | |
|---|---|
| ***C23C 8/10*** | (2006.01) |
| ***C25D 5/50*** | (2006.01) |
| *C25D 5/26* | (2006.01) |
| *C25D 3/22* | (2006.01) |

(52) U.S. Cl. ..... 148/285; 148/277; 148/280; 148/284; 148/518; 148/527; 148/529; 148/531; 148/533; 427/321; 427/433

(58) Field of Classification Search ..... 148/277, 148/280, 284, 285, 518, 527, 529, 531, 533; 427/321, 433

See application file for complete search history.

(56) References Cited

U.S. PATENT DOCUMENTS

| | | | | |
|---|---|---|---|---|
| 6,335,053 | B1 * | 1/2002 | Arezzo et al. | 427/251 |
| 6,564,604 | B2 | 5/2003 | Kefferstein et al. | |
| 2003/0155048 | A1 * | 8/2003 | Zeizinger et al. | 148/533 |
| 2003/0193120 | A1 * | 10/2003 | Gegner | 266/115 |
| 2004/0166360 | A1 * | 8/2004 | Imai et al. | 428/658 |

FOREIGN PATENT DOCUMENTS

| | | | |
|---|---|---|---|
| DE | 100 39 375 | A1 | 3/2002 |
| DE | 102 57 737 | B3 | 2/2004 |
| DE | 102 46 614 | A1 | 4/2004 |
| EP | 1 013 785 | A1 | 6/2000 |
| JP | 59-240089 | | 6/1986 |
| JP | 63062855 | A | 3/1988 |
| JP | 4002758 | | 1/1992 |
| JP | 03-345219 | | 7/1993 |
| JP | 6256925 | | 9/1994 |
| JP | 08325689 | A | 12/1996 |
| JP | 2001-109121 | | 12/2001 |
| JP | 2002012958 | A | 1/2002 |
| JP | 2001-264591 | | 3/2003 |
| WO | WO 01/88216 | * | 11/2001 |
| WO | 03/035922 | A1 | 5/2003 |
| WO | 2004/053203 | A2 | 6/2004 |

* cited by examiner

*Primary Examiner* — Roy King
*Assistant Examiner* — Lois Zheng
(74) *Attorney, Agent, or Firm* — Setter Roche LLP

(57) ABSTRACT

The invention relates to a method for producing a hardened steel part having a cathodic corrosion protection, whereby a) a coating is applied to a sheet made of a hardenable steel alloy in a continuous coating process; b) the coating is essentially comprised of zinc; c) the coating additionally contains one or more oxygen-affine elements in a total amount of 0.1% by weight to 15% by weight with regard to the entire coating; d) the coated steel sheet is then, at least in partial areas and with the admission of atmospheric oxygen, brought to a temperature necessary for hardening and is heated until it undergoes a microstructural change necessary for hardening, whereby; e) a superficial skin is formed on the coating from an oxide of the oxygen-affine element(s), and; f) the sheet is shaped before or after heating, and; g) the sheet is cooled after sufficient heating, whereby the cooling rate is calculated in order to achieve a hardening of the sheet alloy. The invention also relates to a corrosion protection layer for the hardened steel part and to the steel part itself.

28 Claims, 15 Drawing Sheets

Metallographic analysis and surface analysis

METHOD FOR PRODUCING A HARDENED STEEL PART

FIELD OF THE INVENTION

The invention relates to a method for producing a hardened steel part with cathodic corrosion protection, a cathodic corrosion protection, and parts comprised of steel sheets with the corrosion protection.

BACKGROUND OF THE INVENTION

Low-alloy steel sheets, particularly for vehicle body construction are not corrosion resistant after they have been produced using suitable forming steps, either by means of hot rolling or cold rolling. This means that even after a relatively short period of time, moisture in the air causes oxidation to appear on the surface.

It is known to protect steel sheets from corrosion by means of appropriate corrosion protection coatings. According to DIN 50900, Part 1, corrosion is the reaction of a metallic material with its environment, producing a measurable change in the material, and can impair the function of a metallic part or an entire system. In order to avoid corrosion damage, steel is usually protected so that it resists corrosion-inducing influences for the required length of service life. Corrosion damage prevention can be achieved by influencing the properties of the reaction partners and/or by changing the reaction conditions, by separating a metallic material from the corrosive medium through the application of protective coatings, and by means of electrochemical measures.

According to DIN 50902, a corrosion protection coating is a coating produced on a metal or in the region close to the surface of a metal and is comprised of one or more layers. Multilayer coatings are also referred to as corrosion protection systems.

Possible corrosion protection coatings include, for example, organic coatings, inorganic coatings, and metallic coatings. The reason for using metallic corrosion protection coatings is to lend the steel surface the properties of the coating material for the longest possible period of time. The selection of an effective metallic corrosion protection correspondingly requires knowledge of the corrosion-inducing chemical relationships in the system comprised of the steel, coating metal, and aggressive medium.

The coating metal can be electrochemically more noble or less noble than steel. In the first case, the respective coating metal protects the steel only by forming protective coatings. This is referred to as a so-called barrier protection. As soon as the surface of the coating metal develops pores or is damaged, a "local element" forms in the presence of moisture in which the base partner, i.e. the metal to be protected, is attacked. The more noble coating metals include tin, nickel, and copper.

On the one hand, base metals provide protective covering layers; on the other hand, since they are no more noble than steel, they are also attacked when there are breaches in their coating. If such a coating becomes damaged, then the steel is not attacked as a result, but the formation of local elements begins to corrode the base covering metal. This is referred to as a so-called galvanic or cathodic corrosion protection. The base metals include zinc, for example.

Metallic protective layers are applied by means of a variety of methods. Depending on the metal and the method, the bond with the steel surface is chemical, physical, or mechanical and runs the gamut from alloy formation and diffusion to adhesion and simple mechanical bracing.

The metallic coatings should have technological and mechanical properties similar to those of steel and should also behave similarly to steel in reaction to mechanical stresses or plastic deformations. The coatings should also not be damaged by forming and should also not be negatively affected by forming procedures.

When applying hot dipped coatings, the metal to be protected is dipped into liquid molten metal. The hot dipping produces corresponding alloy layers at the phase boundary between the steel and the coating metal. An example of this is hot-dip galvanizing.

In continuous hot-dip galvanizing, the steel band is conveyed through a zinc bath at a bath temperature of approx. 450° C. The coating thickness—typically 6-20 μm—is adjusted by means of slot nozzles (using air or nitrogen as the stripping medium) that strip off the excess zinc scooped up by the band. Hot-dip galvanized items have a high degree of corrosion resistance and good suitability for welding and forming; they are chiefly used in the construction, automotive, and household appliance industries.

It is also known to produce a coating from a zinc-iron alloy. To accomplish this, these items, after the hot-dip galvanizing, undergo a diffusion annealing at temperatures above the melting point of zinc, usually between 480° C. and 550° C. This causes the zinc-iron alloy layers to grow and the overlying zinc layer to shrink. This method is referred to as "galvannealing". The zinc-iron alloy thus generated likewise has a high resistance to corrosion, and a good suitability for welding and forming; its chief uses are in the automotive and household appliance industries. Hot dipping can also be used to produce other coatings made of aluminum, aluminum-silicon, zinc-aluminum, and aluminum-zinc-silicon.

It is also known to produce electrolytically deposited metal coatings, which means that metallic coatings comprised of electrolytes are deposited in an electrolytic fashion, i.e. with current passing through.

Electrolytic coating can also be used for metals that cannot be applied using the hot dipping method. Electrolytic coatings usually have layer thicknesses of between 2.5 and 10 μm and are generally thinner than hot-dipped coatings. Some metals such as zinc also permit the production of thick-layered coatings using the electrolytic coating method. Electrolytically galvanized sheets are primarily used in the automotive industry; because of their high surface quality, these sheets are chiefly used to construct the outer body. They have a good forming capacity, are suitable for welding, store well, and have matte surfaces to which paint adheres well.

Particularly in the automotive field, there is a constant push toward ever lighter raw vehicle bodies. On the one hand, this is because lighter vehicles consume less fuel; on the other hand, raw vehicle bodies need to be lighter in order to offset the weight of the ever more numerous auxiliary functions and auxiliary units with which modem vehicles are being equipped.

At the same time, however, safety requirements for motor vehicles are becoming more and more stringent; the vehicle body must assure the safety of the passengers in the vehicle and protect them in the event of an accident. It has therefore become necessary to provide a higher level of accident safety with lighter vehicle body weights. This can only be achieved by using materials with an increased strength, particularly in the region of the passenger compartment.

In order to achieve the required levels of strength, it is necessary to use steel types with improved mechanical properties or to treat the steel types used in order to provide them with the necessary mechanical properties.

In order to produce steel sheets with an increased strength, it is known to form steel parts and simultaneously harden them in a single step. This method is also referred to as "press hardening". In this process, a steel sheet is heated to a temperature above the austenitization temperature, usually above 900° C., and then formed in a cold die. The die forms the hot steel sheet, which, due to its contact with the surfaces of the cold die, cools very rapidly so that the known hardening effects occur in the steel. It is also known to first form the steel sheet and then cool and harden the formed sheet steel part in a calibration press. By contrast with the first method, this has the advantage that the sheet is formed in the cold state, which makes it possible to achieve more complex shapes. In both methods, however, the heating causes scaling to occur on the surface of the sheet, so that after the forming and hardening, the surface of the sheet must be cleaned, for example by means of sandblasting. Then, the sheet is cut to size and if need be, the necessary holes are punched into it. In this case, it is disadvantageous that the sheets have a very high degree of hardness at the time they are mechanically machined, thus making the machining process expensive, in particular incurring a large amount of tool wear.

The object of U.S. Pat. No. 6,564,604 B2 is to produce steel sheets that then undergo a heat treatment and to create a method for manufacturing parts by hardening these coated steel sheets. In spite of the temperature increase, this approach is intended to assure that the steel sheet is not decarburized and the surface of the steel sheet does not oxidize before, during, or after the hot pressing or heat treatment. To this end, an alloyed, intermetallic mixture is applied to the surface before or after the punching, which should provide protection from corrosion and decarburizing and can also provide a lubricating function. In one embodiment form, the above-mentioned patent proposes using a conventional zinc layer that is clearly applied electrolytically; the intent is for this zinc layer, along with the steel substrate, to transform into a homogeneous Zn—Fe alloy in a subsequent austenitization of the sheet substrate. This homogeneous layer structure is verified by means of microscopic images. This coating should have a mechanical resistance that protects it from melting, thus contradicting earlier assumptions. In practice, however, such a property is not apparent. In addition, the use of zinc or zinc alloys should offer a cathodic protection to the edges if cuts are present. In this embodiment form, however, contrary to the contentions in the above-mentioned patent, a coating of this kind disadvantageously provides hardly any cathodic corrosion protection at the edges and in the region of the sheet metal surface and provides only poor corrosion protection in the event that the coating is damaged.

In the second example in U.S. Pat. No. 6,564,604 B2, a coating is disclosed, which is composed of 50% to 55% aluminum and 45% to 50% zinc, possibly with small quantities of silicon. A coating of this kind is not novel in and of itself and is known by the brand name Galvalume®. According to the above-mentioned patent, the coating metals zinc and aluminum should combine with iron to form a homogeneous zinc-aluminum-iron alloy coating. The disadvantage of this coating is that it no longer achieves a sufficient cathodic corrosion protection; but when it is used in the press hardening process, the predominantly barrier-type protection that it provides is also insufficient due to inevitable surface damage in some regions. In summary, the method described in the above patent is unable to solve the problem that in general, zinc-based cathodic corrosion coatings are not suitable for protecting steel sheets, which, after being coated, are to be subjected to a heat treatment and possibly an additional shaping or forming step.

EP 1 013 785 A1 has disclosed a method for producing a sheet metal part in which the surface of the sheet is to be provided with an aluminum coating or an aluminum alloy coating. A sheet provided with coatings of this kind should be subjected to a press hardening process; possible coating alloys disclosed include an alloy containing 9-10% silicon, 2-3.5% iron, and residual aluminum with impurities, and a second alloy with 2-4% iron and the residual aluminum with impurities. Coatings of this kind are intrinsically known and correspond to the coating of a hot-dip aluminized sheet steel. A coating of this kind has the disadvantage that it only achieves a so-called barrier protection. The moment a barrier protection coating of this kind is damaged or when fractures occur in the Fe—Al coating, the base material, in this case the steel, is attacked and corrodes. No cathodic protection is provided.

It is also disadvantageous that when the steel sheet is heated to the austenitization temperature and undergoes the subsequent press hardening step, even a hot-dip aluminized coating is subjected to such chemical and mechanical stress that the finished part does not have a sufficient corrosion protection coating. This substantiates the view that such a hot-dip aluminized coating is not sufficiently suitable for the press hardening of complex geometries, i.e. for the heating of a steel sheet to a temperature greater than the austenitization temperature.

DE 102 46 614 A1 has disclosed a method for producing a coated structural part for the automotive industry. This method is intended to eliminate the disadvantages of the above-mentioned European patent application 1 013 785 A1. In particular, the contention therein is that by using the dipping method according to European patent application 1 013 785 A, an intermetallic phase would already have been produced during the coating of the steel and that this alloy layer between the steel and the actual coating would be hard and brittle and would fracture during cold forming. As a result, microfractures would occur to such an extent that the coating itself would come loose from the base material and consequently lose its ability to protect. According to DE 102 46 614 A1, therefore, a coating comprised of metal or a metal alloy is applied by means of at least one galvanic coating method in an organic, non-aqueous solution; according to the above-mentioned patent application, aluminum or an aluminum alloy is a particularly well-suited and therefore preferable coating material. Alternatively, zinc or zinc alloys would also be suitable. A sheet coated in this way can then undergo a cold preforming followed by a hot final forming. But this method has the disadvantage that an aluminum coating, even when it has been electrolytically applied, offers no further corrosion protection once the surface of the finished part is damaged since the protective barrier has been breached. An electrolytically deposited zinc coating has the disadvantage that when heated for the hot forming, most of the zinc oxidizes and is no longer available for a cathodic protection. The zinc vaporizes in the protective gas atmosphere.

An object of the present invention is to create a method for producing a part made of hardened steel sheet with an improved cathodic corrosion protection.

A further object of the present invention is to create a cathodic corrosion protection for steel sheets that undergo a forming and hardening.

SUMMARY OF THE INVENTION

In the method according to the present invention, a hardenable steel sheet is provided with a coating comprised of a mixture of mainly zinc and one or more high oxygen affinity elements such as magnesium, silicon, titanium, calcium, aluminum, boron, and manganese, containing 0.1 to 15% by weight of the high oxygen affinity element, and the coated steel sheet, at least in some areas, is heated to a temperature above the austenitization temperature of the sheet alloy with the admission of oxygen, and is formed before or after this; after sufficient heating, the sheet is cooled, the cooling rate being calculated to produce a hardening of the sheet alloy. The result is a hardened part made of a sheet steel that provides a favorable level of cathodic corrosion protection.

The corrosion protection for steel sheets according to the present invention, which first undergo a heat treatment and are then formed and hardened, is a cathodic corrosion protection that is essentially zinc-based. According to the invention, the zinc that comprises the coating is mixed with 0.1% to 15% of one or more high oxygen affinity elements such as magnesium, silicon, titanium, calcium, aluminum, boron, and manganese, or any mixture or alloy thereof. It has turned out that such small quantities of a high oxygen affinity element such as magnesium, silicon, titanium, calcium, aluminum, boron, and manganese achieve a surprising effect in this specific use.

According to the present invention, the high oxygen affinity elements include at least Mg, Al, Ti, Si, Ca, B, and Mn. In the following, whenever aluminum is mentioned, it is intended to also stand for all of the other elements mentioned here.

For example, the coating according to the present invention can be deposited on a steel sheet by means of so-called hot-dip galvanization, i.e. a hot-dip coating process in which a fluid mixture of zinc and the high oxygen affinity element(s) is applied. It is also possible to deposit the coating electrolytically, i.e. to deposit the mixture of zinc and the high oxygen affinity element(s) together onto the sheet surface or to first deposit a zinc coating and then in a second step, to deposit one or more high oxygen affinity elements one after another or in any mixture or alloy thereof onto the zinc surface or to deposit them onto it through vaporization or other suitable methods.

It has surprisingly turned out that despite the small quantity of a high oxygen affinity element such as aluminum, upon heating, a very effective, self-healing, superficial, and full-coverage protective layer forms, which is essentially comprised of $Al_2O_3$ or an oxide of the high oxygen affinity element (MgO, CaO, TiO, $SiO_2$, $B_2O_3$, MnO). This very thin oxide layer protects the underlying zinc-containing corrosion protection coating from oxidation, even at very high temperatures. This means that during the special processing of the galvanized sheet in the press hardening process, an approximately two-layered corrosion protection coating forms, which is composed of a highly effective cathodic layer with a high zinc content that is in turn protected from oxidation and vaporization by a very thin oxidation protection coating comprised of one or more oxides ($Al_2O_3$, MgO, CaO, TiO, $SiO_2$, $B_2O_3$, MnO). A cathodic corrosion protection coating is thus produced that has a surprising resistance to chemical attack. This means that it is necessary to perform the heat treatment in an oxidizing atmosphere. It is in fact possible to avoid oxidation if protective gas is used (an oxygen-free atmosphere), but the zinc would then vaporize due to the high vapor pressure.

It has also turned out that the corrosion protection coating according to the invention for the press hardening process also has such a high stability that a forming step following the austenitization of the sheets does not destroy this layer. Even if microfractures develop on the hardened part, the cathodic protective action nevertheless remains more powerful than the protective action of the known corrosion protection coatings for the press hardening process.

In order to provide a sheet with the corrosion protection according to the invention, in a first step, a zinc alloy with an aluminum content of greater than 0.1 wt. % but less than 15 wt. %, in particular less than 10 wt. %, and even more preferably of less than 5 wt. %, can be applied to a steel sheet, in particular an alloyed steel sheet, and then in a second step, parts of the coated sheet can be machined out, in particular cut out or punched out, and heated to a temperature above the austenitization temperature of the sheet alloy with the admission of atmospheric oxygen and subsequently cooled at an increased speed. A forming of the part cut out from the sheet (the sheet bar) can occur before or after the sheet is heated to the austenitization temperature.

It is assumed that in the first step of the process when the sheet is being coated, a thin inhibition phase comprised in particular of $Fe_2Al_{5-x}Zn_x$ forms on the sheet surface or in the proximal region of the sheet, which inhibits the Fe—Zn diffusion in a fluid metal coating process that occurs in particular at a temperature of up to 690° C. Thus in the first process step, the sheet with a zinc-metal coating and added aluminum is produced, which has an extremely thin inhibition phase only toward the sheet surface, i.e. the proximal region of the coating, that effectively prevents a rapid growth of an iron-zinc binding phase. It is also conceivable that the mere presence of aluminum reduces the tendency for iron-zinc diffusion in the region of the boundary layer.

If in the second step, the sheet provided with a zinc-aluminum-metal coating is heated to the austenitization temperature of the sheet material with the admission of atmospheric oxygen, then the metal coating on the sheet liquefies for the time being. On the distal surface, the higher oxygen affinity aluminum from the zinc reacts with atmospheric oxygen to form a solid oxide or alumina, which produces a drop in the aluminum-metal concentration in this direction, resulting in a steady diffusion of aluminum toward depletion, i.e. toward the distal region. This alumina enrichment in the coating region exposed to the air then functions as an oxidation protection for the coating metal and as a vaporization inhibitor for the zinc.

Also during heating, the aluminum is drawn by steady diffusion from the proximal inhibition phase toward the distal region and is available there to form the surface layer of $Al_2O_3$. This achieves the sheet coating production that leaves behind a highly effective cathodic coating with a high zinc content.

A suitable example is a zinc alloy with an aluminum content of greater than 0.2 wt. % but less than 4 wt. %, preferably of greater than 0.26 wt. % but less than 2.5 wt. %.

If in the first step, the application of the zinc alloy coating onto the sheet surface suitably occurs during the passage through a liquid metal bath at a temperature of greater than 425° C. but less than 690° C., in particular from 440° C. to 495° C., with subsequent cooling of the coated sheet, it is possible not only to efficiently produce the proximal inhibition phase and to achieve an observable, very good diffusion inhibition in the region of the inhibition layer, but also to improve the hot forming properties of the sheet material.

An advantageous embodiment of the invention comprises a method that uses a hot rolled or cold rolled steel band with a thickness of for example greater than 0.15 mm and with a concentration range of at least one of the alloy elements within the following weight percentage limits:

| | | |
|---|---|---|
| carbon | up to 0.4, | preferably 0.15 to 0.3 |
| silicon | up to 1.9, | preferably 0.11 to 1.5 |
| manganese | up to 3.0, | preferably 0.8 to 2.5 |
| chromium | up to 1.5, | preferably 0.1 to 0.9 |
| molybdenum | up to 0.9, | preferably 0.1 to 0.5 |
| nickel | up to 0.9, | |
| titanium | up to 0.2, | preferably 0.02 to 0.1 |
| vanadium | up to 0.2 | |
| tungsten | up to 0.2, | |
| aluminum | up to 0.2, | preferably 0.02 to 0.07 |
| boron | up to 0.01, | preferably 0.0005 to 0.005 |
| sulfur | max. 0.01, | preferably max. 0.008 |
| phosphorus | max 0.025, | preferably max. 0.01 |
| residual iron and impurities. | | |

The surface structure of the cathodic corrosion protection according to the invention has been demonstrated to be particularly favorable for a high degree of adhesion of paints and lacquers.

The adhesion of the coating to the sheet steel item can be further improved if the surface coating has a zinc-rich, intermetallic iron-zinc-aluminum phase and an iron-rich iron-zinc-aluminum phase, the iron-rich phase having a ratio of zinc to iron of at most 0.95 ($Zn/Fe \leqq 0.95$), preferably from 0.20 to 0.80 ($Zn/Fe=0.20$ to 0.80), and the zinc-rich phase having a ratio of zinc to iron of at least 2.0 ($Zn/Fe \geqq 2.0$), preferably from 2.3 to 19.0 ($Zn/Fe=2.3$ to 19.0).

Examples of the invention will be explained in greater detail below in conjunction with the drawings.

DETAILED DESCRIPTION OF THE PREFERRED EMBODIMENTS

Figure 1:
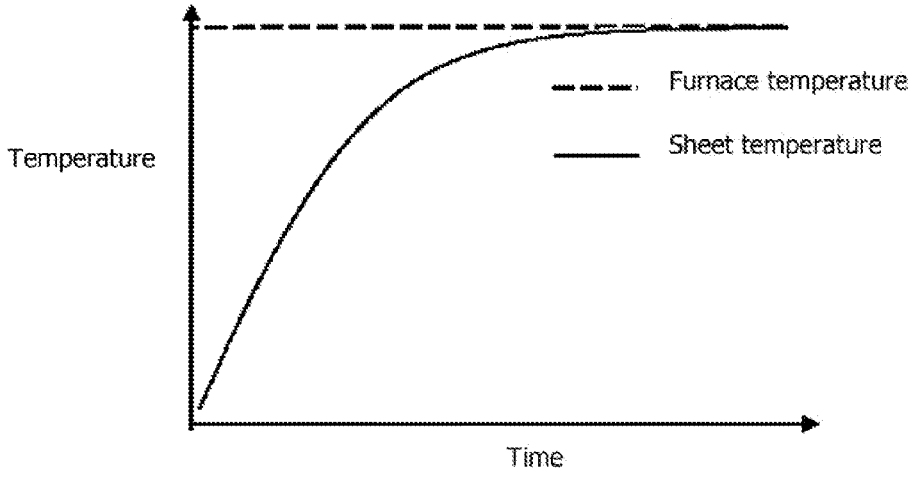
FIG. 1 shows a heating curve of test sheets during annealing in a radiation furnace.

Approximately 1 mm thick steel sheets with a corrosion protection coating that is the same on both sides, with a layer thickness of 15 μm were manufactured and tested. The sheets were placed for 4 minutes 30 seconds in a 900° C. radiation furnace and then rapidly cooled between steel plates. The time between removal of the sheets from the furnace and the cooling between the steel plates was 5 seconds. The heating curve of the sheets during the annealing in the radiation furnace essentially followed the curve shown in FIG. 1.

Then, the test specimens obtained were analyzed for visual and electrochemical differences. Assessment criteria here included the appearance of the annealed steel sheets and the protection energy. The protection energy is the measure for the electrochemical protection of the coating, determined by means of galvanostatic dissolution.

The electrochemical method of galvanostatic dissolution of the metallic surface coatings of a material makes it possible to classify the corrosion protection mechanism of the coating. The potential/time behavior of a coating to be protected from corrosion is ascertained at a predetermined, constant current flow. A current density of 12.7 $mA/cm^2$ was predetermined for the measurements. The measurement device is a three-electrode system. A platinum network was used as a counter electrode; the reference electrode was comprised of Ag/AgCl (3M). The electrolyte was comprised of 100 g/l $ZnSO_4*5H_2O$ and 200 g/l NaCl, dissolved in deionized water.

If the potential required to dissolve the layer is greater than or equal to the steel potential, which can easily be determined by stripping or grinding off the surface coating, then this is referred to as a pure barrier protection without an active cathodic corrosion protection. The barrier protection is characterized in that it separates the base material from the corrosive medium.

The results of the coating examples will be described below.

Example 1 (Not According to the Invention)

A hot-dip aluminized steel sheet is produced by conveying a steel sheet through a liquid aluminum bath. When annealed at 900° C, the reaction of the steel with the aluminum coating produces an aluminum-iron surface layer. The correspondingly annealed sheet has a dark gray appearance; the surface is homogeneous and does not have any visually discernible defects.

Figure 2:
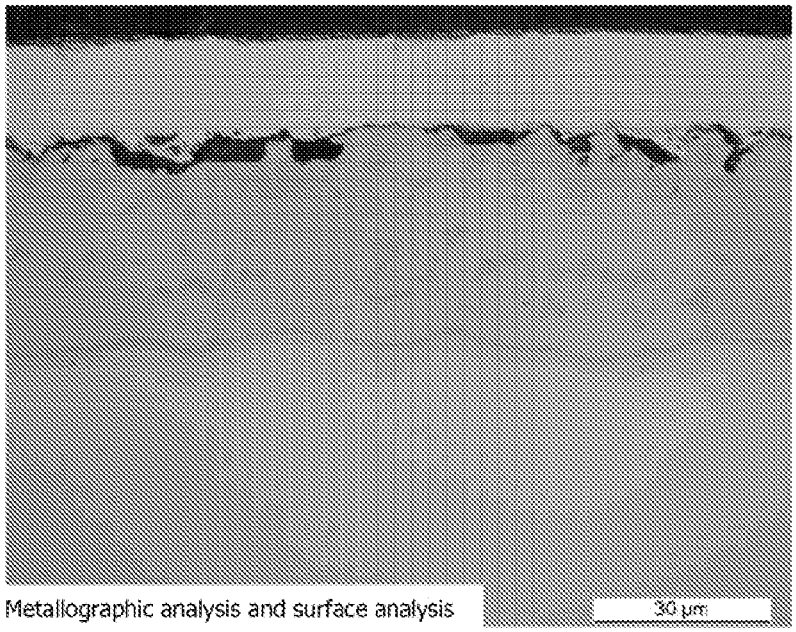
FIG. 2 shows a microscopic image of the transverse section of an annealed test specimen of a steel sheet that has been hot-dip aluminized with a method not according to the invention.
Figure 3:
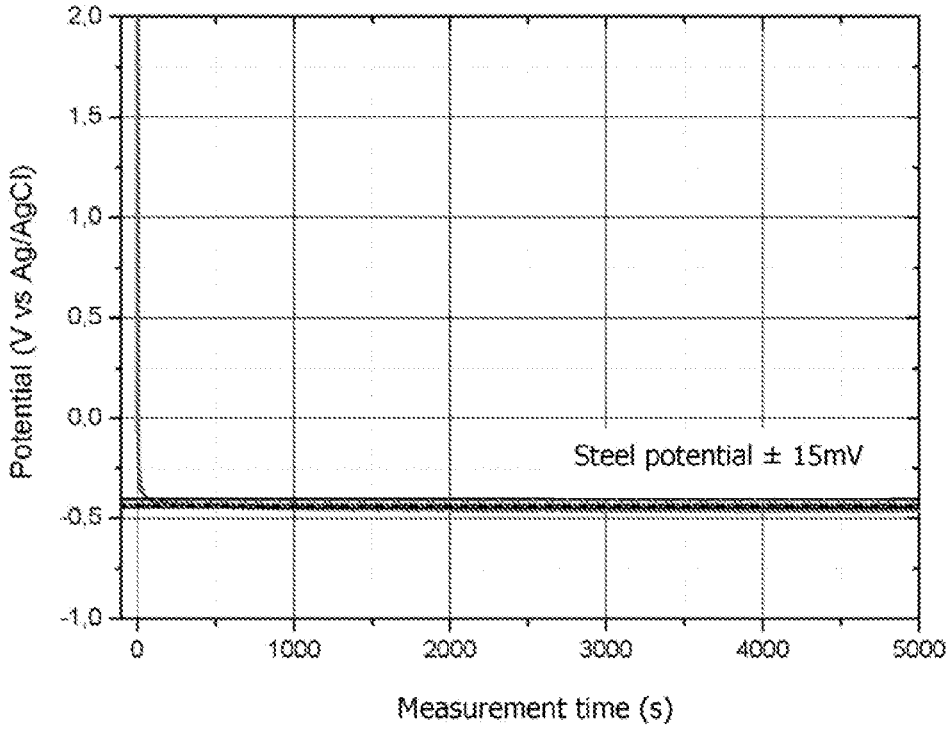
FIG. 3 shows the potential curve over the measurement time in a galvanostatic dissolution for a steel sheet that has been hot-dip aluminized with a method not according to the invention.

The galvanostatic dissolution of the surface coating of the hot-dip aluminized sheet must have a very high potential (+2.8 V) at the beginning of the measurement in order to assure the current density of 12.7 mA/cm$^2$. After a short measurement time, the required potential falls to the steel potential. It is clear from this behavior that an annealed sheet with a coating produced by hot-dip aluminization provides very efficient barrier protection. However, as soon as holes develop in the coating, the potential falls to the steel potential and damage to the base material begins to occur. Since the potential required for the dissolution never falls below the steel potential, this represents a pure barrier layer without cathodic corrosion protection. FIG. 3 shows the potential curve over the measurement time and FIG. 2 shows a microscopic image of a transverse section.

Example 2 (Not According to the Invention)

Figure 4:
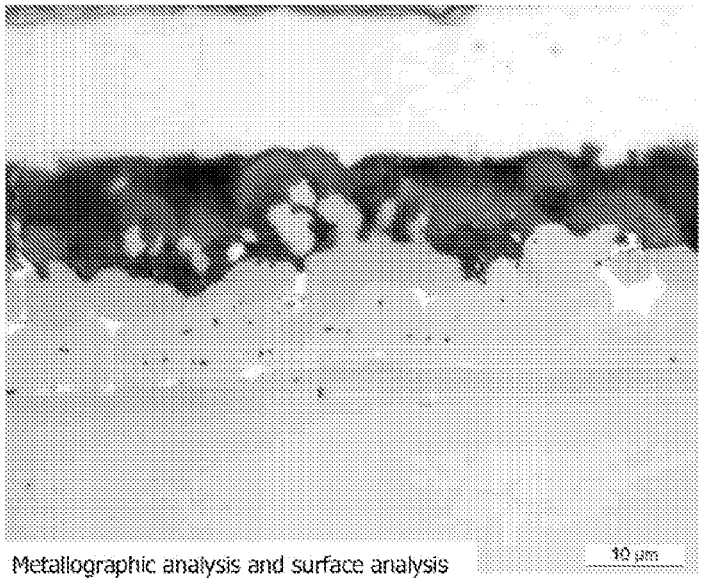
FIG. 4 shows a microscopic image of the transverse section of an annealed test specimen of a steel sheet with an aluminum-zinc-silicon alloy coating not according to the invention.

A steel sheet was covered with an aluminum-zinc coating by means of hot-dip galvanization, the molten metal being comprised of 55% aluminum, 44% zinc, and approx. 1% silicon. After the coating of the surface and a subsequent annealing at 900° C., a gray-blue surface without defects is observed. FIG. 4 depicts a transverse section.

Figure 5:
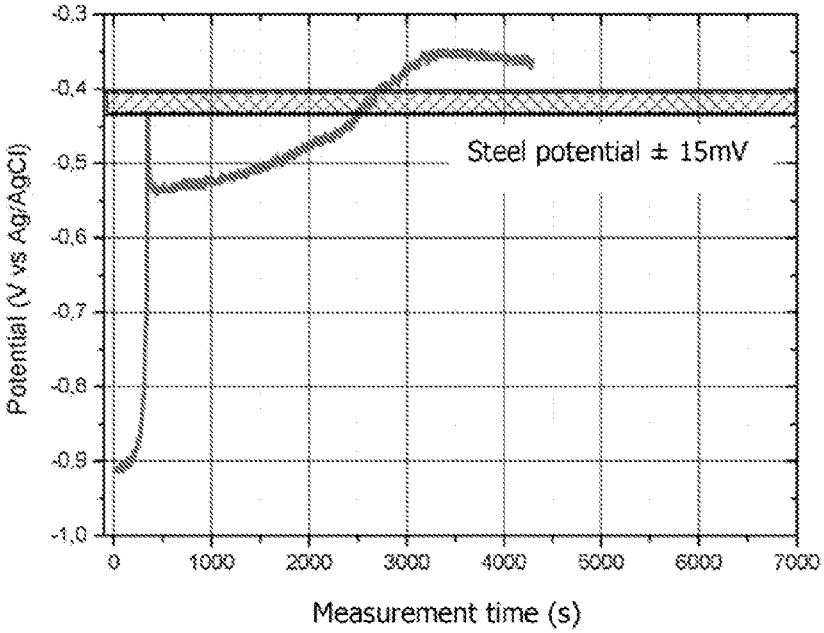
FIG. 5 shows the potential curve over the measurement time in a galvanostatic dissolution trial of a steel sheet with an aluminum-zinc-silicon alloy coating not according to the invention.

The annealed material then undergoes the galvanostatic dissolution. At the beginning of the measurement, the material demonstrates an approx. −0.92 V potential required for dissolution, which thus lies significantly below the steel potential. This value is comparable to the potential required for dissolution of a hot-dip galvanized coating before the annealing process. But this very zinc-rich phase ends after only approx. 350 seconds of measurement time. Then there is a rapid increase to a potential that now lies just below the steel potential. After this coating is breached, the potential first falls to a value of approx. −0.54 V and then continuously rises until it reaches a value of approx. −0.35 V. Only then does it begin to gradually fall to the steel potential. Because of the very negative potential that lies significantly below the steel potential at the beginning of the measurement, in addition to the barrier protection, this material does provide a certain amount of cathodic corrosion protection. However, the part of the coating that supplies a cathodic corrosion protection is depleted after only approx. 350 seconds of measurement time. The remaining coating can only provide a slight amount of cathodic corrosion protection since the difference between the required potential for the coating dissolution and the steel potential is now only equivalent to less than 0.12 V. In a poorly conductive electrolyte, this part of the cathodic corrosion protection is no longer usable. FIG. 5 shows the potential/time graph.

Example 3 (According to the Invention)

Figure 6:
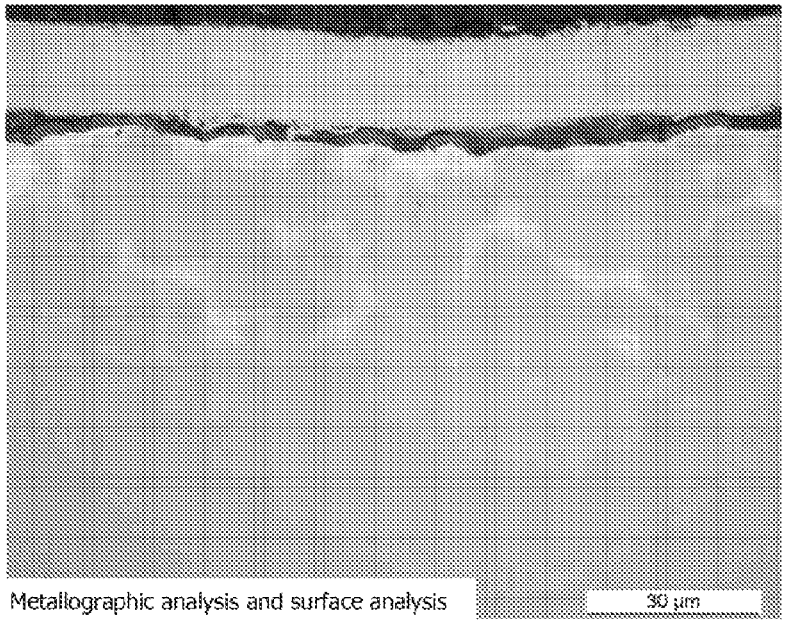
FIG. 6 shows a microscopic image of the transverse section of an annealed test specimen of a cathodically corrosion-protected sheet according to the invention.

A steel sheet is hot-dip galvanized in a heat melting bath of essentially 95% zinc and 5% aluminum. After annealing, the sheet has a silver-gray surface without defects. In the transverse section (FIG. 6), it is clear that the coating is comprised of a light phase and a dark phase, these phases representing Zn—Fe—Al-containing phases. The light phases are more zinc-rich and the dark phases are more iron-rich. Part of the aluminum reacts to the atmospheric oxygen during annealing and forms a protective $Al_2O_3$ skin.

Figure 7:
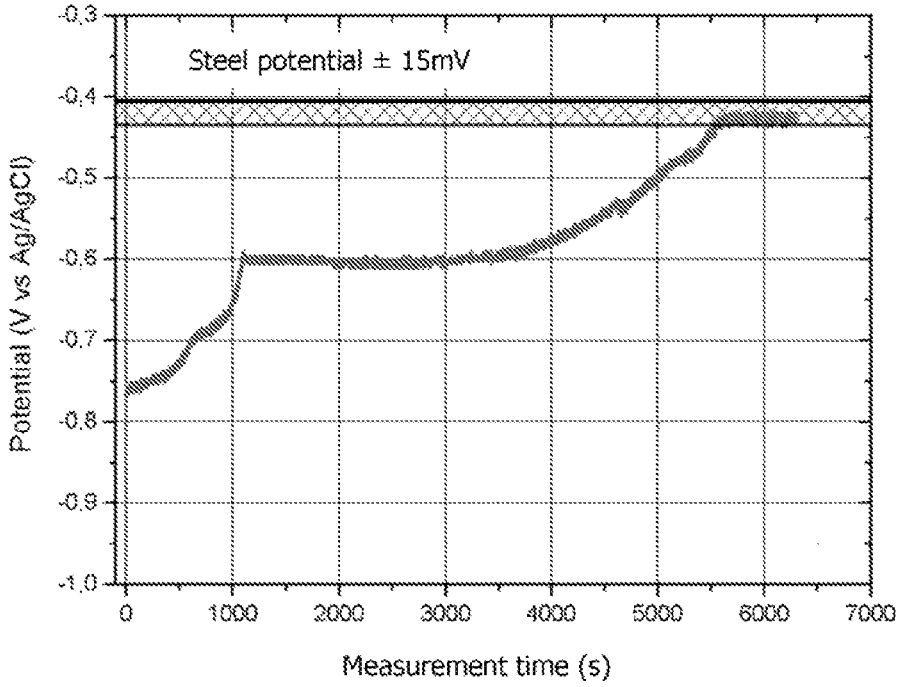
FIG. 7 shows the potential curve for the sheet according to FIG. 6.

In the galvanostatic dissolution, at the beginning of the measurement, the sheet has a potential required for dissolution of approx. −0.7 V. This value lies significantly below the potential of the steel. After a measurement time of approx. 1,000 seconds, a potential of approx. −0.6 V sets in. This potential also lies significantly below the steel potential. After a measurement time of approx. 3,500 seconds, this part of the coating is depleted and the required potential for dissolution of the coating approaches the steel potential. After the annealing, this coating consequently provides a cathodic corrosion protection in addition to the barrier protection. Up to a measurement time of 3,500 seconds, the potential has a value of ≦−0.6 V so that an appreciable cathodic protection is maintained over a long time period, even if the sheet has been brought to austenitization temperature. FIG. 7 shows the potential/time graph.

Example 4 (According to the Invention)

Figure 8:
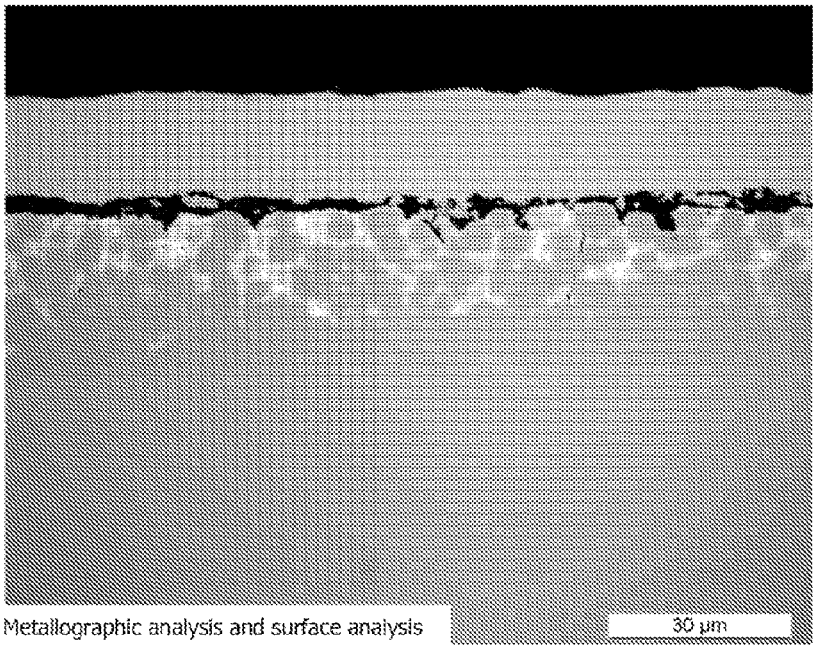
FIG. 8 shows a microscopic image of the transverse section of an annealed test specimen of a sheet provided with a cathodic corrosion protection according to the invention.

The sheet is conveyed through a heat melting bath or zinc bath with a zinc content of 99.8% and an aluminum content of 0.2%. During the annealing, aluminum contained in the zinc coating reacts to atmospheric oxygen and forms a protective $Al_2O_3$ skin. Continuous diffusion of the high oxygen affinity aluminum to the surface causes this protective skin to form and keeps it maintained. After annealing, the sheet has a silver-gray surface without defects. During annealing, diffusion transforms the zinc coating that was originally approx. 15 μm thick into a coating approx. 20 to 25 μm thick; this coating (FIG. 8) is composed of a dark-looking phase with a Zn/Fe composition of approx. 30/70 and a light region with a Zn/Fe composition of approx. 80/20. The surface of the coating has been verified to have an increased aluminum content. The detection of oxides on the surface indicates the presence of a thin protective coating of $Al_2O_3$.

Figure 9:
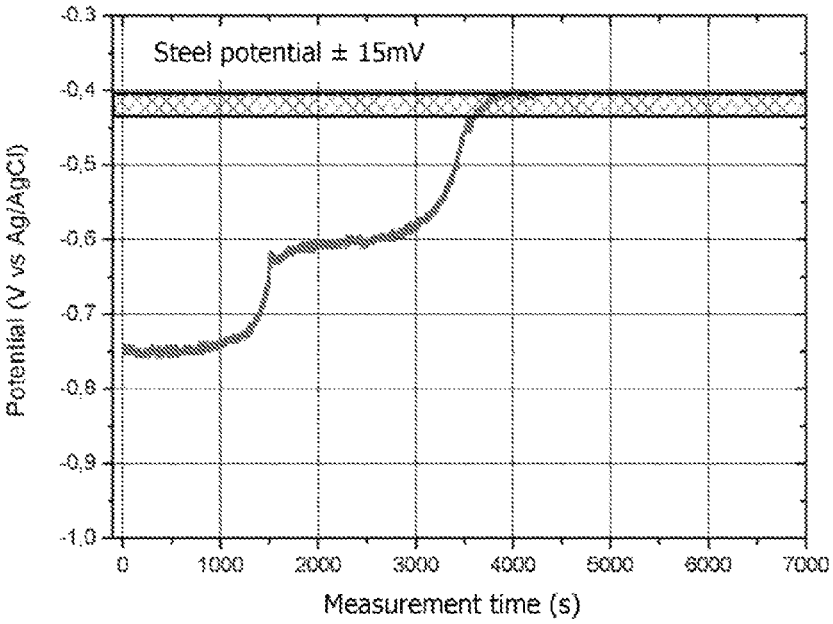
FIG. 9 shows the potential curve for the sheet according to FIG. 8.

At the beginning of the galvanostatic dissolution, the annealed material has a potential of approx. −0.75 V. After a measurement time of approx. 1,500 seconds, the potential required for dissolution rises to ≦−0.6 V. The phase lasts until a measurement time of approx. 2,800 seconds. Then, the required potential rises to the steel potential. In this case, too, a cathodic corrosion protection is provided in addition to the barrier protection. Up to a measurement time of 2,800 seconds, the potential has a value of ≦−0.6 V. A material of this kind consequently also provides a cathodic protection over a very long time period. FIG. 9 shows the potential/time graph.

Example 5 (Not According to the Invention)

After the sheet band emerges from the zinc bath (approx. 450° C. band temperature), the sheet is heated to a temperature of approx. 500° C. This causes the zinc layer to completely convert into Zn—Fe phases. The zinc layer is thus completely converted into Zn—Fe phases, i.e. all the way to the surface. This yields zinc-rich phases on the steel sheet that all have a Zn to Fe ratio of >70% zinc. In this corrosion protection coating, the zinc bath contains a small amount of aluminum, on the order of magnitude of approx. 0.13%.

A 1 mm-thick steel sheet with the above-mentioned heat-treated and completely converted coating is heated for 4 minutes 30 seconds in a 900° C. furnace. This yields a yellow-green surface.

The yellow-green surface indicates an oxidation of the Zn—Fe phases during the annealing. No presence of an aluminum oxide protective layer could be verified. The reason for the absence of an aluminum oxide layer can be explained by the fact that during the annealing treatment, the presence of the solid Zn—Fe phases prevents the aluminum from migrating to the surface as rapidly and protecting the Zn—Fe coating from oxidation. When this material is heated, at temperatures around 500° C., there is not yet any fluid zinc-rich phase because this only forms at higher temperatures of 782° C. Once 782° C. is reached, a thermodynamically generated fluid, zinc-rich phase is present, in which the aluminum is freely available. The surface layer, however, is not protected from oxidation.

Figure 10:
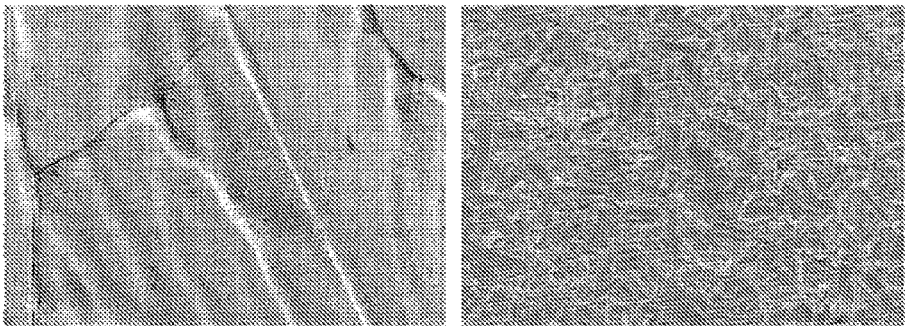
FIG. 10 shows microscopic images of the surface of a sheet that has been coated according to the invention in the unhardened—not yet heat treated—state shown in FIGS. 8 and 9 in comparison to a sheet that has been coated and treated by methods not according to the invention.
Figure 11:
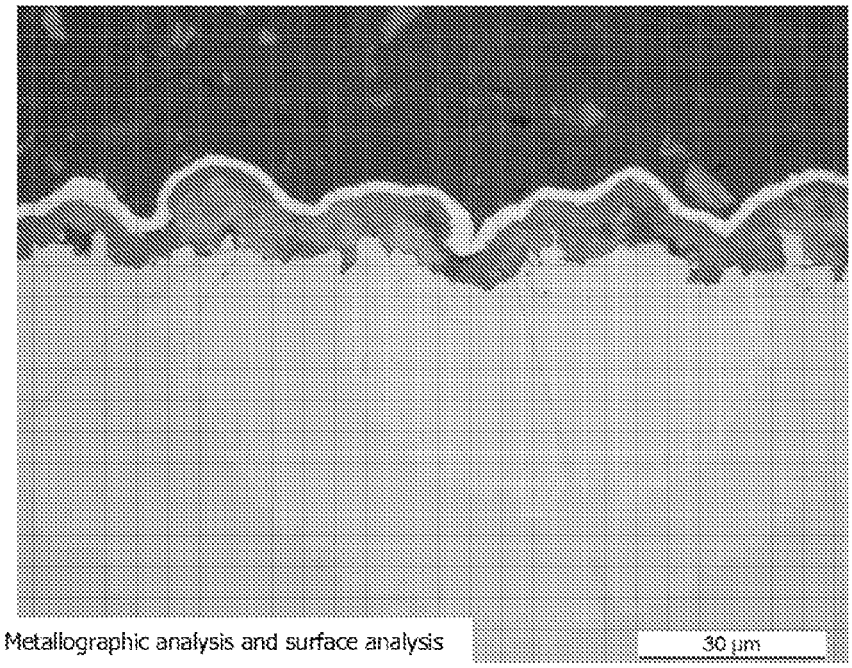
FIG. 11 shows a microscopic image of the transverse section of a sheet that has been coated and treated by methods not according to the invention.

At this point in time, it is possible that the corrosion protection coating is already partially oxidized and it is no longer possible for a full-coverage aluminum oxide skin to form. The coating in the transverse section appears rough and wavy and is comprised of Zn oxides and Zn—Fe oxides (FIG. 11). In addition, due to the highly crystalline, acicular surface structure of the surface, the surface area of the above-mentioned material is much greater, which could also be disadvantageous for the formation of a full-coverage, thicker aluminum oxide protection coating. In the initial state, i.e. when it has not yet been heat treated, the above-mentioned coating not according to the invention constitutes a brittle coating with numerous fractures oriented both transversely and longitudinally in relation to the coating. (FIG. 10, compared to the previously mentioned example according to the invention (on the left in the figure).) As a result, in the course of the heating, both a decarburization and an oxidation of the steel substrate can occur, particularly in cold formed parts.

Figure 12:
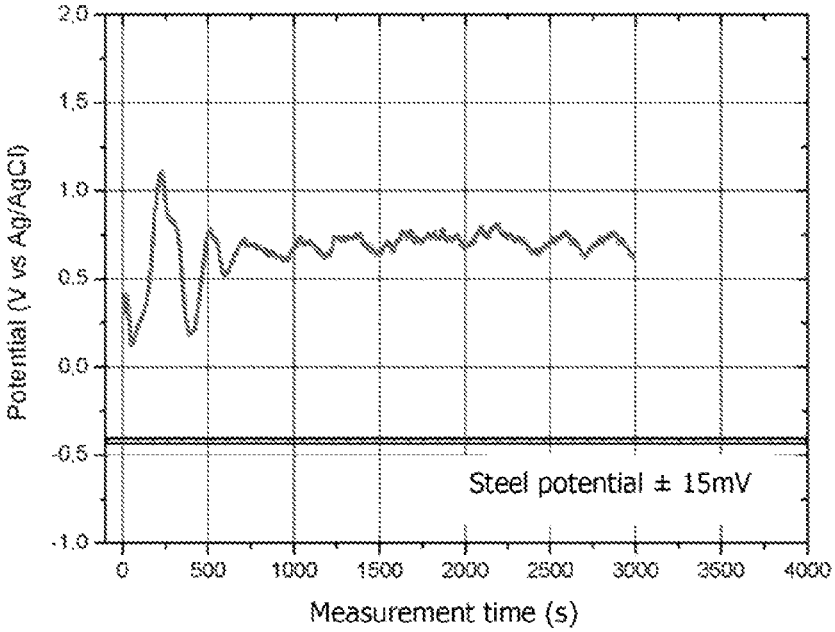
FIG. 12 shows the potential curve for the sheet not according to the invention in FIG. 11.

In the galvanostatic dissolution of this material, for the dissolution with a constant current flow, at the beginning of the measurement, a potential of +1V is applied, which then levels off to a value of approx. +0.7V. Here, too, the potential during the entire dissolution lies significantly below the steel potential (FIG. 12). These annealing conditions thus also indicate a pure barrier protection. Here, too, no cathodic corrosion protection could be verified.

Example 6 (According to the Invention)

As in the example mentioned above, immediately after the hot-dip galvanization, a sheet undergoes a heat treatment at approx. 490° C. to 550° C., which only partially converts the zinc layer into Zn—Fe phases. The process here is carried out so that only part of the phase conversion occurs so that as yet unconverted zinc with aluminum is present at the surface and consequently, the free aluminum is available as an oxidation protection for the zinc coating.

Figure 13:
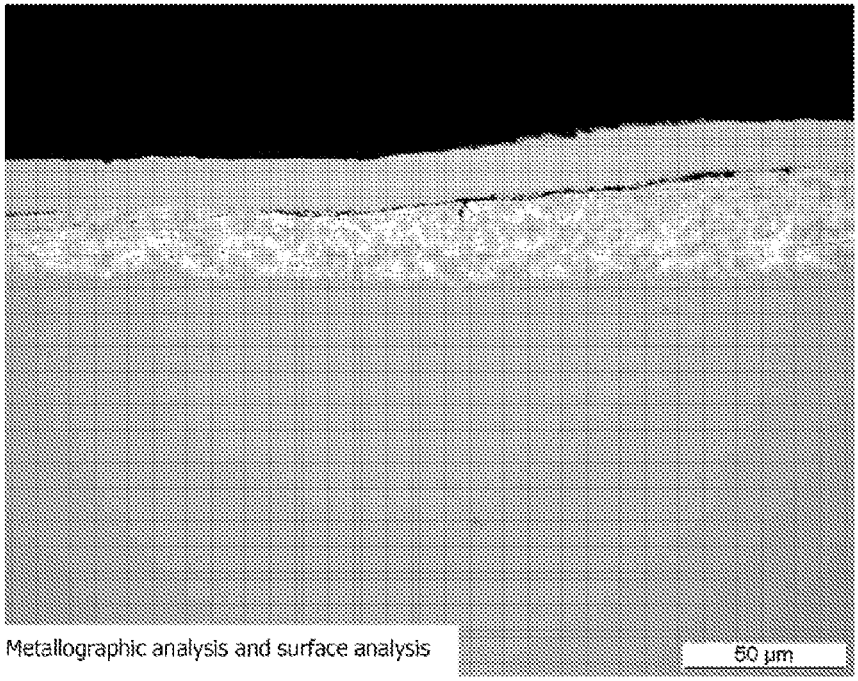
FIG. 13 shows a microscopic image of the transverse section of a sheet that has been coated and heat treated according to the invention.

A 1 mm-thick steel sheet with the heat-treated coating that is only partially converted into Zn—Fe phases according to the invention is inductively heated rapidly to 900° C. This yields a gray surface without defects. An REM/EDX test of the transverse section (FIG. 13) shows a surface layer approx. 20 μm thick; the originally approx. 15 μm-thick zinc covering on the coating has, during the inductive annealing, transformed due to the diffusion into an approx. 20 μm Zn—Fe coating; this coating has the two-phase structure that is typical of the invention, having a "leopard pattern" with a phase that looks dark in the image and contains a Zn/Fe composition of approx. 30/70 and light regions with a Zn/Fe composition of approx. 80/20. Moreover, certain individual areas have zinc contents of ≧90%. The surface turns out to have a protective coating of aluminum oxide.

Figure 14:
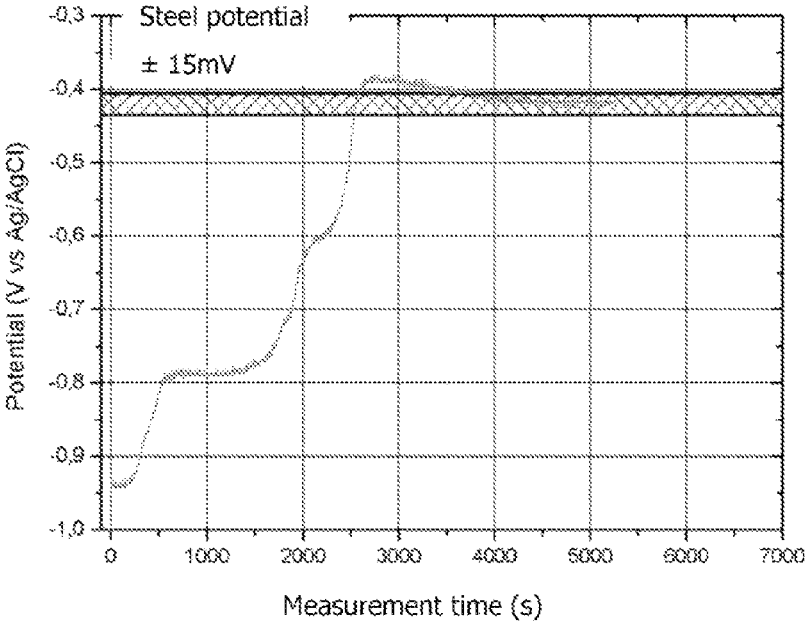
FIG. 14 shows the potential curve for the sheet according to FIG. 13.

In the galvanostatic dissolution of the surface coating, a rapidly heated sheet bar with the hot-dip galvanized coating according to the invention, which is—by contrast with example 5—only partially heat treated before the press hardening, at the beginning of the measurement, the potential required for dissolution is approx. −0.94 V and is therefore comparable to the potential required for dissolution of an unannealed zinc coating. After a measurement time of approx. 500 seconds, the potential rises to a value of −0.79 V and thus lies significantly below the steel potential. After a measurement time of approx. 2,200 seconds, ≦0.6 V are required for dissolution; the potential then rises to −0.38 V and then approaches the steel potential (FIG. 14). The rapidly heated material, which has been incompletely heat-treated according to the invention before the press hardening, can provide both a barrier protection and a very good cathodic corrosion protection. In this material, too, the cathodic corrosion protection can be maintained for a very long measurement time.

Example 7 (Not According to the Invention)

A sheet is electrolytically galvanized by electrochemical depositing of zinc onto steel. During the annealing, the diffusion of the steel with the zinc coating forms a thin Zn—Fe layer. Most of the zinc oxidizes into zinc oxide, which has a green appearance due to the simultaneous formation of iron oxides. The surface has a green appearance with localized scaly areas in which the zinc oxide layer does not adhere to the steel.

Figure 15:
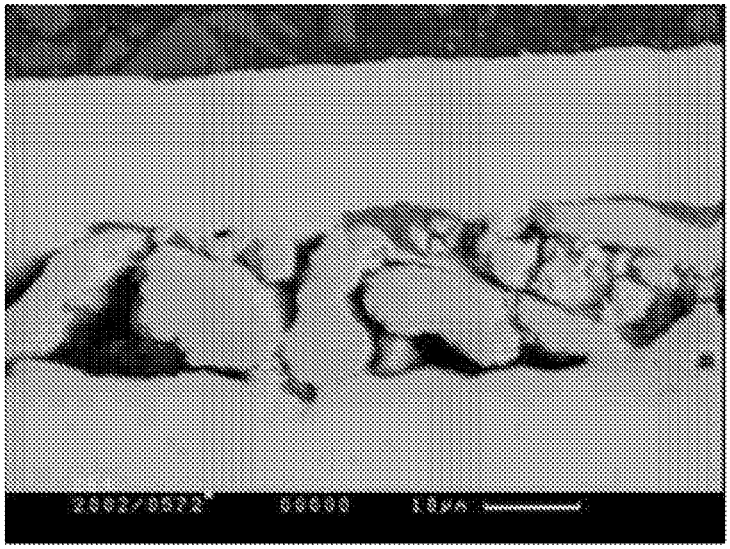
FIG. 15 shows a microscopic image of the transverse section of a steel sheet that has been electrolytically galvanized not according to the invention.
Figure 16:
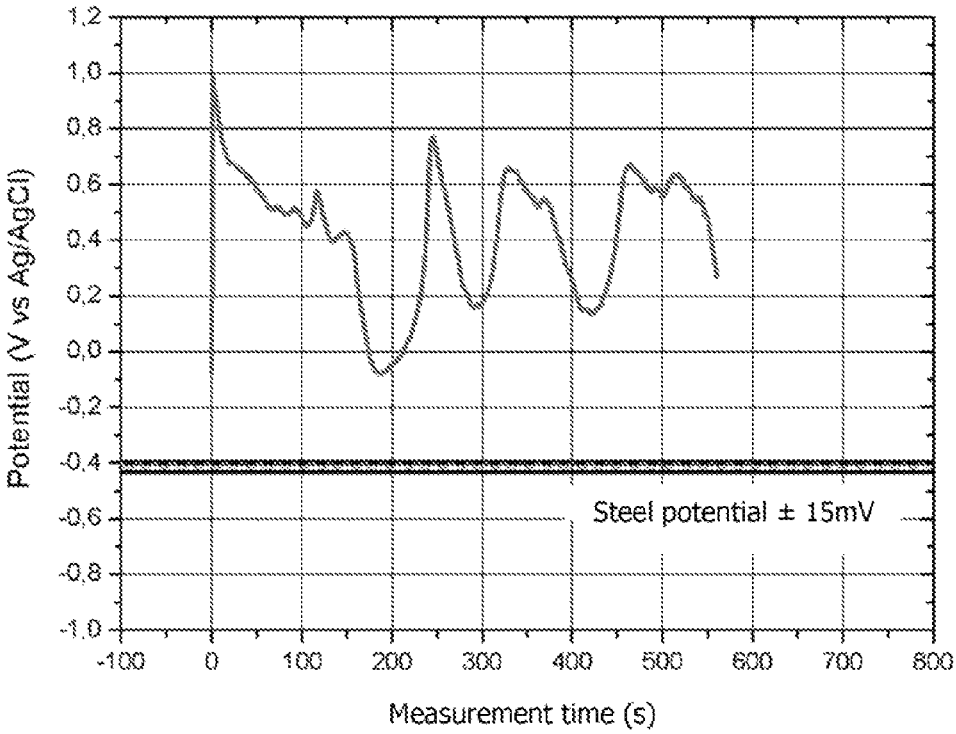
FIG. 16 shows the potential curve for the sheet according to FIG. 15.

An REM/EDX test (FIG. 15) of the sample sheet confirms, in the transverse section, that a majority of the coating is comprised of a covering of zinc-iron oxide. In the galvanostatic dissolution, the potential required for the current flow is approx. +1V and thus lies significantly above the steel potential. In the course of the measurement, the potential fluctuates between +0.8 and −0.1 V, but lies above the steel potential during the entire dissolution of the coating. It follows, therefore, that the corrosion protection of an annealed, electrolytically galvanized coating is a pure barrier protection, but is less efficient than in a hot-dip aluminized sheet since the potential at the beginning of the measurement is lower in an electrolytically coated sheet than it is in a hot-dip aluminized sheet. The potential required for dissolution lies above the steel potential during the entire dissolution. Consequently even an annealed, electrolytically coated sheet does not provide a cathodic corrosion protection at any time. FIG. 16 shows the potential/time graph. The potential lies essentially above the steel potential, but fluctuates in detail from one test to another, despite identical test conditions.

Example 8 (Not According to the Invention)

A sheet is produced by means of electrochemical depositing of zinc and nickel onto a steel surface. The weight ratio of zinc to nickel in the corrosion protection coating is approx. 90/10. The deposited layer thickness is approx. 5 μm.

The sheet with the coating is annealed in the presence of atmospheric oxygen for 4 minutes 30 seconds at 900° C. During the annealing, the diffusion of the steel with the zinc coating produces a thin diffusion layer comprised of zinc, nickel, and iron. Due to the lack of aluminum, though, most of the zinc oxidizes into zinc oxide. The surface has a scaly, green appearance with small, localized spalling areas where the oxide coating does not adhere to the steel.

Figure 17:
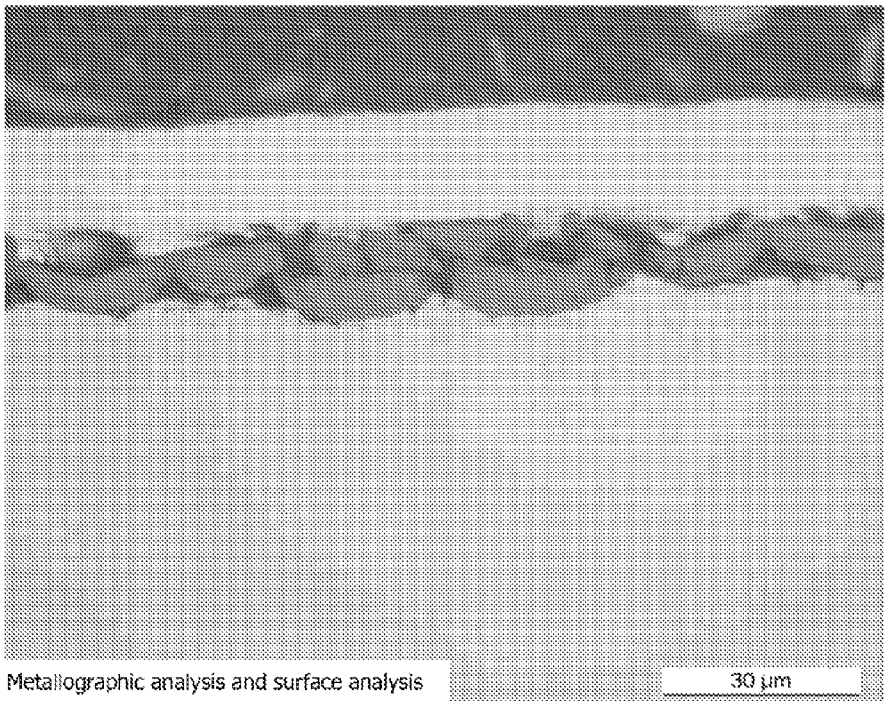
FIG. 17 shows a microscopic image of the transverse section of an annealed test specimen of a sheet with a zinc-nickel coating not according to the invention.

An REM/EDX test of a transverse section (FIG. 17) demonstrates that most of the coating has oxidized and is consequently unavailable for cathodic corrosion protection.

Figure 18:
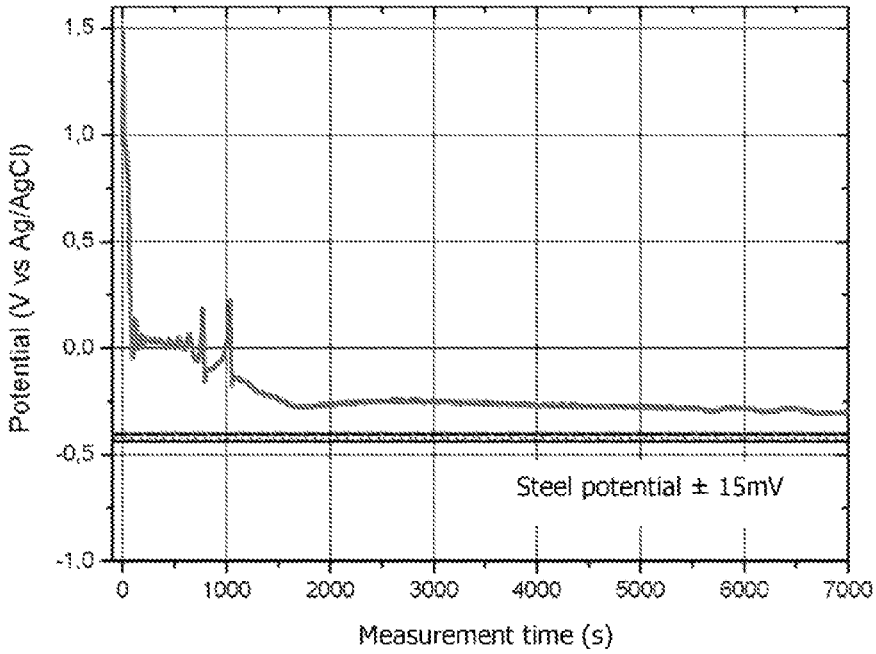
FIG. 18 shows the potential curve for the sheet not according to the invention in FIG. 17.

At the beginning of the measurement, at 1.5 V, the potential required for dissolution of the coating lies far above the steel potential. After approximately 250 seconds, it falls to approx. 0.04 V and oscillates within a range of ±0.25 V. After approx. 1,700 seconds of measurement time, it levels off to a value of −0.27 V and remains at this value until the end of the measurement. The potential required for dissolution of the coating lies significantly above the steel potential for the entire measurement time. Consequently, after the annealing, this coating performs a pure barrier function without any cathodic corrosion protection whatsoever (FIG. 18).

9. Verification of the Aluminum Oxide Layer by Means of GDOES Analysis

A GDOES (Glow Discharge Optical Emission Spectroscopy) test can be used to verify the formation of the aluminum oxide layer during the annealing (and the migration of the aluminum to the surface).

For the GDOES measurement:

A 1 mm-thick steel sheet coated according to example 4, with a coating thickness of 15 μm was heated in air for 4 min 30 s in a 900° C. radiation furnace, then rapidly cooled between 5 cm-thick steel plates, and then the surface was analyzed with a GDOES measurement.

Figure 25:
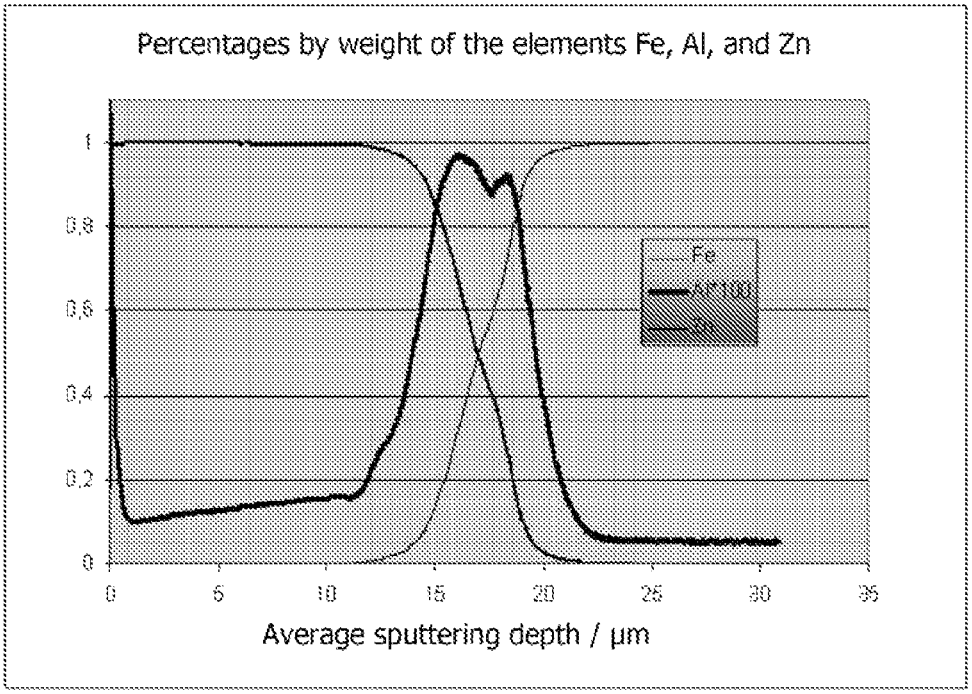
FIG. 25 is a graph depicting the distribution of the elements aluminum, zinc, and iron depending on the depth of the surface coating before the sheet is annealed.
Figure 26:
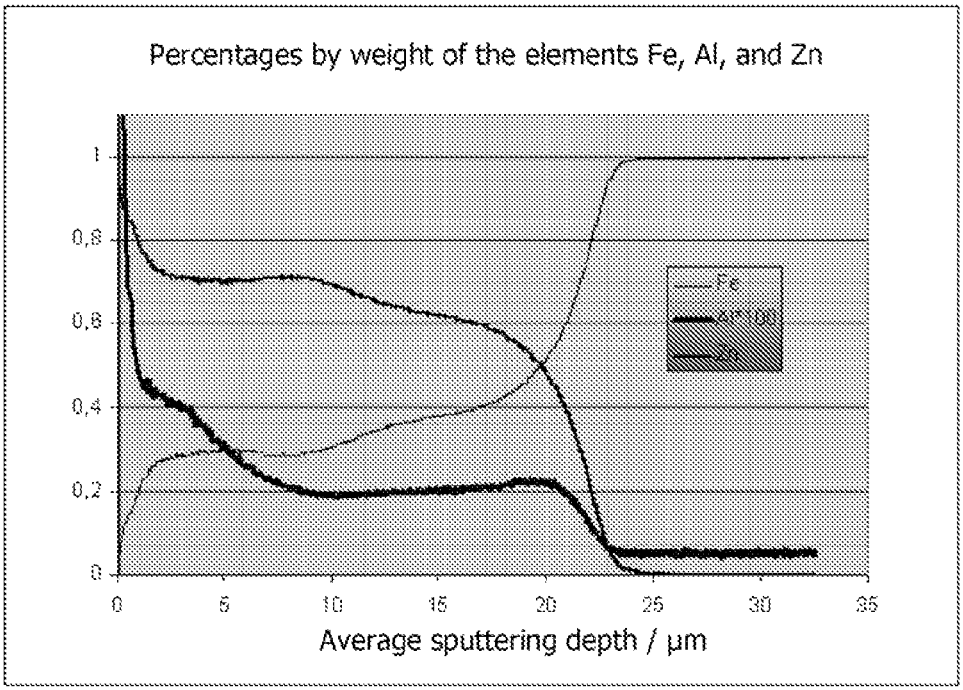
FIG. 26 is a graph depicting the distribution of the elements aluminum, zinc, and iron depending on the depth of the surface coating after the sheet is annealed, as proof of the formation of a protective aluminum oxide skin on the surface.

FIGS. 25 and 26 show GDOES analyses of the sheet coated according to example 4, before and after the annealing. Before the hardening (FIG. 25) after approx. 15 μm, the transition from the zinc coating to the steel is reached; after the hardening, the coating is approx. 23 μm thick.

After the hardening (FIG. 26), the increased aluminum content at the surface is evident in comparison to the unannealed sheet.

10. CONCLUSION

Figure 19:
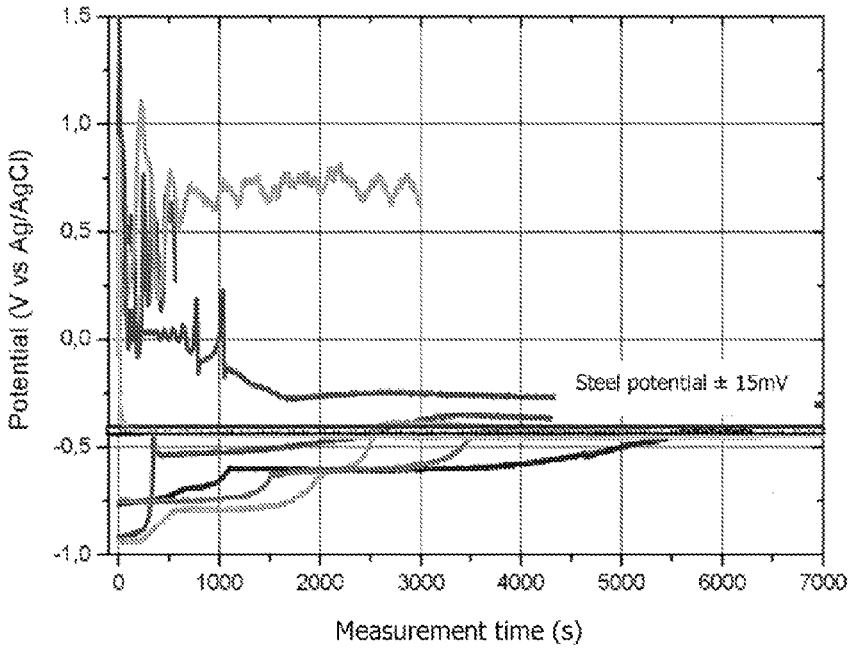
FIG. 19 is a comparison of the potentials required for dissolution for the tested materials as a function of time.

The examples demonstrate that only the corrosion protected sheets used according to the invention for the press hardening process have a cathodic corrosion protection after the annealing, in particular with a cathodic corrosion protection energy of >4 J/cm$^2$. FIG. 19 shows a comparison of the potentials required for dissolution as a function of time.

In order to properly evaluate the quality of the cathodic corrosion protection, it is not permissible to only examine the length of time for which the cathodic corrosion protection can be maintained; it is also necessary to take into account the difference between the potential required for the dissolution and the steel potential. The greater this difference is, the more effective the cathodic corrosion protection, even with poorly conductive electrolytes. The cathodic corrosion protection is negligibly low in poorly conductive electrolytes when there is a voltage difference of 100 mV from the steel potential. Even with a small difference from the steel potential, however, a cathodic corrosion protection is still present in principal as long as a current flow is detected when a steel electrode is used; this is, however, negligibly low for practical aspects since the corrosive medium must be very conductive for this to contribute to the cathodic corrosion protection. This is practically never the case with atmospheric influences (rainwater, humidity, etc.). For this reason, the evaluation did not take into account the difference between the potential required for dissolution and the steel potential, but instead used a threshold of 100 mV below the steel potential. Only the difference up to this threshold was taken into account for the evaluation of the cathodic protection.

Figure 20:
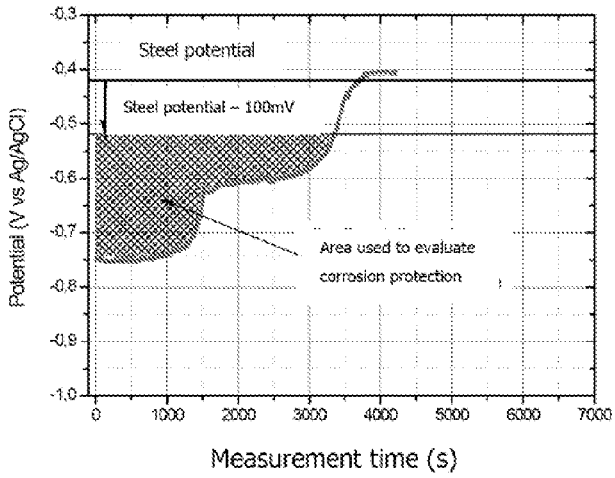
FIG. 20 is a graph depicting the area used to assess the corrosion protection.

The area between the potential curve during the galvanostatic dissolution and the established threshold of 100 mV below the steel potential was established as an evaluation criterion for the cathodic protection of the respective surface coating after annealing (FIG. 20). Only the area that lies below the threshold is taken into account. The area above the threshold is negligibly small and makes practically no contribution whatsoever to the cathodic corrosion protection and is therefore not included in the evaluation.

Figure 21:
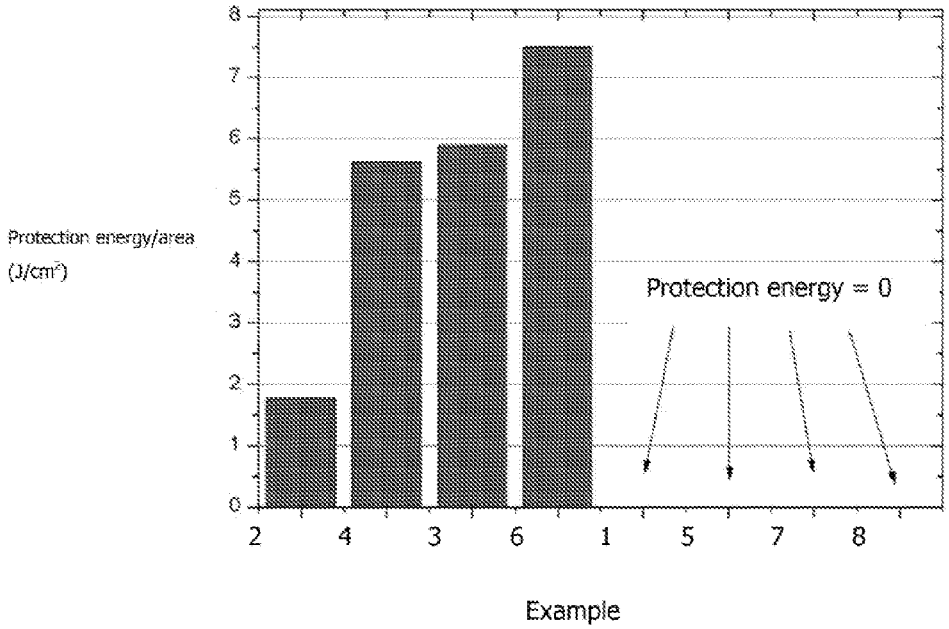
FIG. 21 is a graph depicting the different protection energies of the tested materials.
Figure 22:
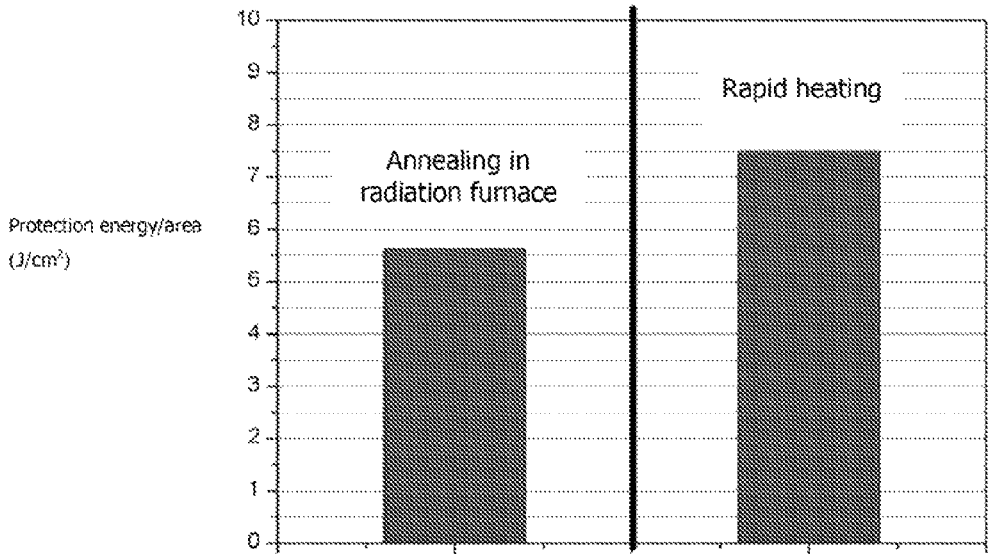
FIG. 22 is a graph depicting the different protection energies of a sheet according to the invention, under two different heating conditions.
Figure 23:
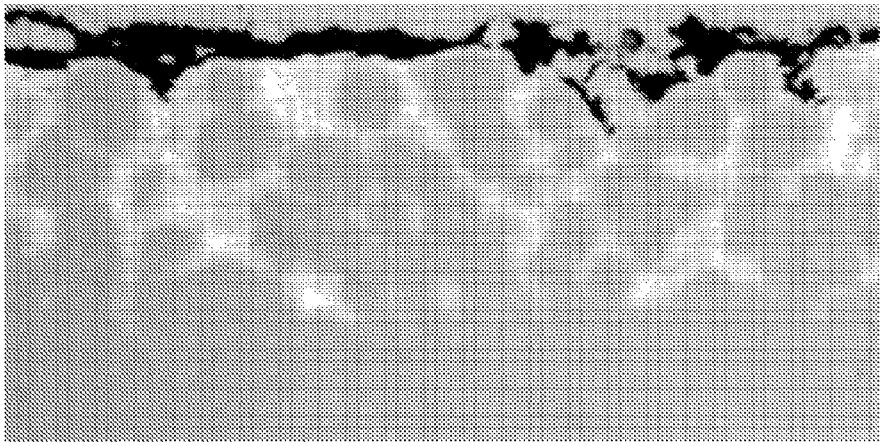
FIG. 23 qualitatively depicts the phase formation as a "leopard pattern" in coatings according to the invention.
Figure 24:
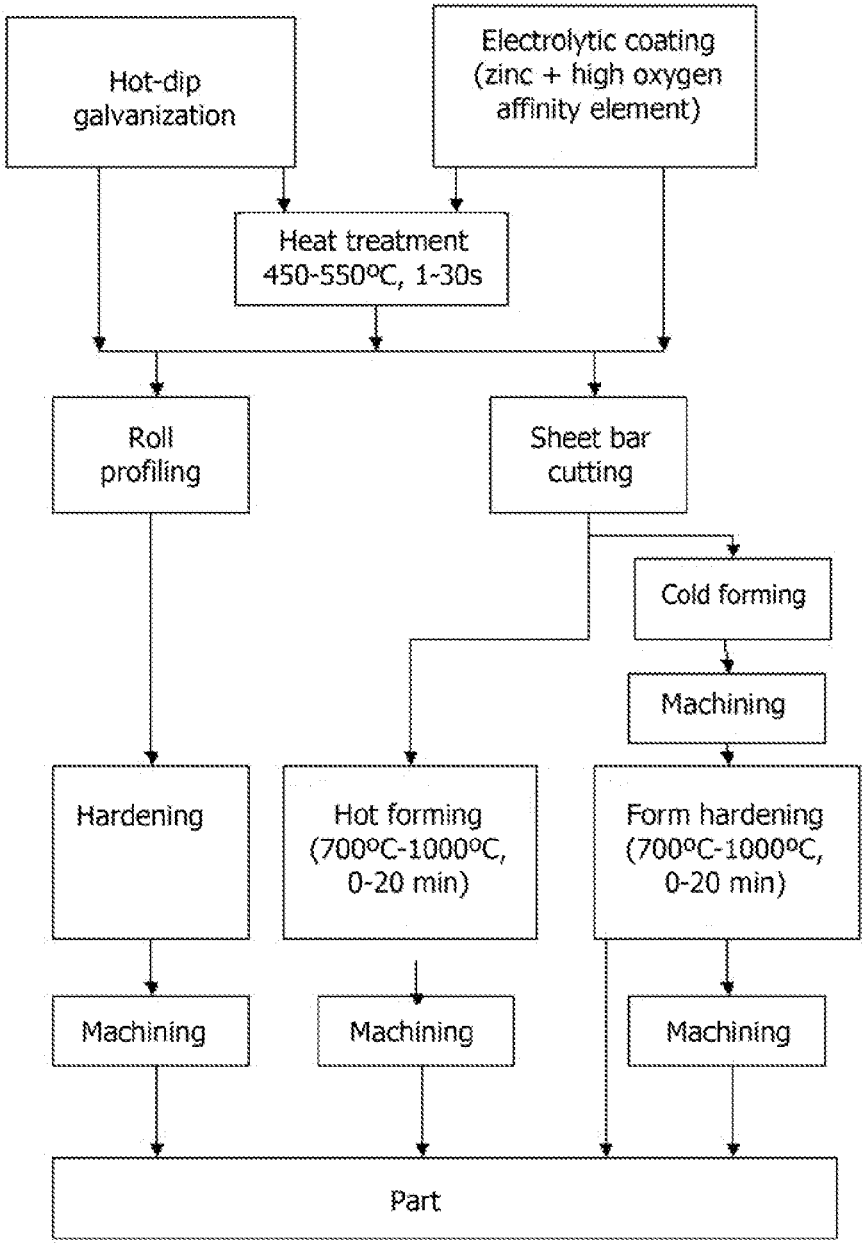
FIG. 24 is a flowchart depicting the possible process sequences according to the invention.

The area thus obtained, when multiplied by the current density, corresponds to the protection energy per unit area with which the base material can be actively protected from corrosion. The greater this energy is, the better the cathodic corrosion protection. FIG. 21 compares the determined protection energies per unit area to one another. While a sheet with the aluminum-zinc coating comprised of 55% aluminum and 44% zinc that is known from the prior art only has a protection energy per unit area of approx. 1.8 J/cm$^2$, the protection energies per unit area of sheets coated according to the invention are 5.6 J/cm$^2$ and 5.9 J/cm$^2$.

For the cathodic corrosion protection according to the present invention, it is determined below that 15 μm-thick coatings and the above-described processing and testing conditions yield a cathodic corrosion protection energy of at least 4 J/cm$^2$.

A zinc coating that has been electrolytically deposited onto the surface of the steel sheet cannot by itself provide a corrosion protection according to the invention, even after a heating step that brings it to a temperature higher than the austenitization temperature. However, the present invention can also be achieved with an electrolytically deposited coating according to the invention. To accomplish this, the zinc, together with the high oxygen affinity element(s) can be simultaneously deposited in an electrolysis step onto the surface of the sheet so that the surface of the sheet is provided with a coating of a homogeneous structure that contains both zinc and the high oxygen affinity element(s). When heated to the austenitization temperature, a coating of this kind behaves in the same manner as a coating of the same composition that is deposited on the surface of the sheet by means of hot-dip galvanization.

In another advantageous embodiment form, only zinc is deposited onto the surface of the sheet in a first electrolysis step and the high oxygen affinity element(s) is/are deposited onto the zinc layer in a second electrolysis step. The second layer comprised of the high oxygen affinity elements here can be significantly thinner than the zinc layer. When such a coating according to the invention is heated, the outer covering—which is composed of the high oxygen affinity element(s) and is situated on the zinc layer—oxidizes, thus protecting the underlying zinc with an oxide skin. Naturally, the high oxygen affinity element(s) is/are selected so that they do not vaporize from the zinc layer or do not oxidize without leaving behind a protective oxide skin.

In another advantageous embodiment form, first a zinc layer is electrolytically deposited and then a layer of the high oxygen affinity element(s) is deposited by means of vaporization or other suitable non-electrolytic coating processes.

It is typical of the coatings according to the invention that in addition to the surface protective layer comprised of an oxide of the high oxygen affinity element(s), in particular $Al_2O_3$, after the heat treatment for the press hardening, the transverse sections of the coatings according to the invention have a typical "leopard pattern" that is composed of a zinc-rich, intermetallic Zn—Al phase and an iron-rich Fe—Zn—Al phase, the iron-rich phase having a ratio of zinc to iron of at most 0.95 (Zn/Fe≦0.95), preferably from 0.20 to 0.80 (Zn/Fe=0.20 to 0.80), and the zinc-rich phase having a ratio of zinc to iron of at least 2.0 (Zn/Fe≧2.0), preferably from 2.3 to 19.0 (Zn/Fe=2.3 to 19.0). It was possible to verify that only when such a two-phase structure is achieved is there a sufficient amount of cathodic protective action. Such a two-phase structure is only produced, however, if the $Al_2O_3$ has already formed on the surface of the coating. By contrast with a known coating according to U.S. Pat. No. 6,564,604 B2, which has a homogeneous makeup in terms of structure and texture in which the Zn—Fe needles are supposed to lie in a zinc matrix, in this case, a non-homogeneous structure is composed of at least two different phases.

The invention is advantageous in that a continuous and therefore economically produced steel sheet is achieved for the manufacture of press-hardened parts and has a cathodic corrosion protection that is reliably maintained even when the sheet is heated above the austenitization temperature and subsequently formed.

The invention claimed is:

1. A method for producing a hardened steel part having cathodic corrosion protection, comprising:

applying a coating to a hardenable steel alloy in a continuous coating process, wherein the coating consists essentially of zinc and contains one or more high oxygen affinity elements in a total quantity of 0.1% by weight to 15% by weight in relation to the overall coating;

bringing the coated hardenable steel alloy, at least in some areas, to a temperature necessary for hardening, with the admission of atmospheric oxygen, and heating the coated hardenable steel alloy until it undergoes a microstructural change necessary for the hardening; wherein a superficial skin consisting essentially of an oxide of the high oxygen affinity element(s) is formed on the coating, which protects the zinc-containing coating from oxidation;

forming the hardenable steel alloy into a sheet before or after the heating; and cooling the sheet after sufficient heating, a cooling rate being calculated in order to achieve a hardening of the sheet alloy.

2. The method as recited in claim 1, wherein the high oxygen affinity elements used in the mixture are magnesium and/or silicon and/or titanium and/or calcium and/or aluminum and/or manganese and/or boron.

3. The method as recited in claim 1, comprising applying the coating using a hot dipping process in which a mixture is used that is composed essentially of zinc and the high oxygen affinity element(s).

4. The method as recited in claim 1, comprising applying the coating electrolytically.

5. The method as recited in claim 4, comprising applying the electrolytic coating by first depositing a zinc layer onto the hardenable steel alloy and then depositing the high oxygen affinity element(s) onto the previously deposited zinc layer.

6. The method as recited in claim 4, comprising electrolytically depositing a zinc layer onto the surface of the hardenable steel alloy and then depositing a coating composed of the high oxygen affinity element(s) onto the zinc surface.

7. The method as recited in claim 6, wherein the high oxygen affinity element(s) is/are vaporized.

8. The method as recited in claim 1, wherein the coating comprises 0.2 wt. % to 5 wt. % of the high oxygen affinity elements.

9. The method as recited in claim 1, wherein the coating comprises 0.26 wt. % to 2.5 wt. % of the high oxygen affinity elements.

10. The method as recited in claim 1, wherein the high oxygen affinity element consists essentially of aluminum.

11. The method as recited in claim 1, wherein the coating mixture is selected so that during the heating, the coating develops an oxide skin comprising oxides of the high oxygen affinity element(s) and the coating is composed of at least two phases, a zinc-rich phase and an iron-rich phase.

12. The method as recited in claim 11, wherein the iron-rich phase has a ratio of zinc to iron of at most 0.95(Zn/Fe<0.95), and the zinc-rich phase has a ratio of zinc to iron of at least 2.0(Zn/Fe>2.0).

13. The method as recited in claim 11, wherein the iron-rich phase has a ratio of zinc to iron of approx. 30:70 and the zinc-rich phase has a ratio of zinc to iron of approx. 80:20.

14. The method as recited in claim 1, wherein the coating has individual areas with zinc contents of >90%.

15. The method as recited in claim 1, wherein the coating is embodied so that with an initial thickness of 15 μm, after the hardening process, it develops a cathodic protective action of at least 4 $J/cm^2$.

16. The method as recited in claim 1, comprising producing the coating with the mixture of zinc and the high oxygen affinity element(s) during the passage of the hardenable steel alloy through a liquid metal bath at a temperature of between 425° C. and 690° C., and subsequently cooling the coated hardenable steel alloy.

17. The method as recited in claim 1, comprising producing the coating with the mixture of zinc and the high oxygen affinity element(s) during the passage of the hardenable steel alloy through a liquid metal bath at a temperature of between 440° C. and 495° C., and subsequently cooling the coated hardenable steel alloy.

18. The method as recited in claim 1, comprising inductively heating the hardenable steel alloy.

19. The method as recited in claim 1, comprising inductively heating the hardenable steel alloy in a die.

20. The method as recited in claim 1, comprising heating the hardenable steel alloy in a radiation furnace.

21. The method as recited in claim 1, comprising cooling the sheet in a forming die.

22. The method as recited in claim 1, comprising cooling the sheet during formation using a cooled forming die.

23. The method as recited in claim 1, comprising cooling the sheet after forming the sheet in a forming die.

24. The method as recited in claim 1, comprising cooling the sheet in a form hardening die into which the formed sheet is inserted after heating and in which a form-locked engagement occurs between the formed sheet and a correspondingly shaped, cooled form hardening die.

25. The method as recited in claim 1, comprising heating and cooling the hardenable steel alloy in a form hardening die, wherein the heating is executed inductively, and after the inductive heating, the forming die is cooled.

26. The method as recited in claim 1, wherein the forming and the hardening of the part are performed with a roll forming device; the coated sheet, at least in some areas, is heated to the austenitization temperature, roll-formed before, during, and/or after this, and then cooled in the roll forming die at a cooling rate that results in a hardening of the sheet alloy.

27. The method as recited in claim 1, comprising bringing the coated hardenable steel alloy, at least in some areas to a temperature above the austenitization temperature.

28. The method as recited in claim 1, comprising bringing the coated hardenable steel alloy, at least in some areas to at least 900° C.

* * * * *